US007813691B2

(12) United States Patent
Yoshida

(10) Patent No.: US 7,813,691 B2
(45) Date of Patent: Oct. 12, 2010

(54) COMPONENT MOUNTING STRUCTURE

(75) Inventor: Takeshi Yoshida, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 869 days.

(21) Appl. No.: 11/711,446

(22) Filed: Feb. 27, 2007

(65) Prior Publication Data

US 2007/0212138 A1 Sep. 13, 2007

(30) Foreign Application Priority Data

Feb. 28, 2006 (JP) ..... 2006-052246
Jan. 31, 2007 (JP) ..... 2007-020773

(51) Int. Cl.
*G03G 15/20* (2006.01)
*G03G 21/00* (2006.01)

(52) U.S. Cl. ..... 399/351; 399/117; 399/123; 399/283; 399/284; 399/350

(58) Field of Classification Search ..... 399/350, 399/351, 126
See application file for complete search history.

(56) References Cited

U.S. PATENT DOCUMENTS 3,927,936 A * 12/1975 Komori et al. ..... 399/126
5,303,010 A * 4/1994 Takano et al. ..... 399/126
6,131,011 A * 10/2000 Kojima et al. ..... 399/351
6,519,430 B2 * 2/2003 Higeta et al. ..... 399/109
6,763,209 B2 * 7/2004 Higeta et al. ..... 399/109
6,775,498 B2 * 8/2004 Palumbo et al. ..... 399/176
6,907,210 B2 * 6/2005 Wazana et al. ..... 399/109
2005/0238395 A1 * 10/2005 Ueno et al. ..... 399/350
2006/0188286 A1 * 8/2006 Yuge ..... 399/102

FOREIGN PATENT DOCUMENTS

JP 60091382 A * 5/1985
JP 2000-075753 3/2000
JP 2004-302268 10/2004

* cited by examiner

*Primary Examiner*—David M Gray
*Assistant Examiner*—Francis Gray
(74) *Attorney, Agent, or Firm*—The Webb Law Firm

(57) ABSTRACT

A component mounting structure mounting a press component with the press component in a condition of elastic pressing against a pressed article, and comprising an intermediate fixing member mounted on a fixing frame supporting the pressed article and capable of position adjustment in a direction of pressing of the press component against the pressed article; a fixing connection part, supporting the press component, mounted on the intermediate fixing member, and capable of position adjustment in the same direction as the direction of pressing; a setting part setting a distance of separation between the fixing connection part and the pressed article within a prescribed range; a first fixing mechanism fixing a position of the intermediate fixing member with respect to the fixing frame; and a second fixing mechanism fixing a position of the fixing connection part with respect to the intermediate fixing member.

2 Claims, 14 Drawing Sheets

COMPONENT MOUNTING STRUCTURE

CROSS-REFERENCE TO RELATED APPLICATIONS

The present application claims priority from JP2006-52246 as filed in Japan by the same applicant in Japan on Feb. 28, 2006 and from JP2007-20773 as filed in Japan by the same applicant on Jan. 31, 2007, and the entirety of the filed applications is hereby incorporated herein by reference.

BACKGROUND OF THE INVENTION

1. Field of the Invention

The present invention relates to a component mounting structure for mounting in a condition wherein a press component is pressed elastically against a pressed article.

2. Description of the Related Art

Mounted for example on the photoconductive drums equipped in copiers, printers, facsimile machines, and other electrophotographic-type image forming devices are components such as cleaning blades for the removal of residual toner attached to the surface of the photoconductive drum and rubbing rollers for polishing of the surface of the photoconductive drum. In such a case, the photoconductive drum constitutes a pressed article, and the cleaning blades and rubbing rollers constitute press components. The cleaning blades and rubbing rollers are mounted in a state of elastic pressing against the surface of the photoconductive drum.

Conventionally, in such a component mounting structure wherein a press component is mounted such that the press component and pressed article are in a state of mutual elastic pressing, positioning of the press component in a fixed position with respect to the pressed article involves an mounting worker adjusting the position of a fixing section provided on the press component relative to the pressed article, thus determining the degree of pressing. Examples thereof are the structures of JP 2000-75753 and JP 2004-302268.

With the above-described conventional technology, however, there is a danger that the fixing position of the press component with respect to the pressed article may vary depending on the mounting worker. In addition, the conventional technology has a disadvantage in the form of skill being required in order to accurately mount the pressed article and the press component in state of mutual pressing at a prescribed pressing force.

SUMMARY OF THE INVENTION

In light of such existing circumstances, the present invention aims to realize a component mounting structure capable of accurate mounting with a pressed article and a press component in a state of mutual pressing at a prescribed pressing force, and with no particular skill being required.

First Characteristic Feature

The first characteristic feature of the present invention is the provision of a component mounting structure mounting a press component with the press component in a condition of elastic pressing against a pressed article that comprises an intermediate fixing member mounted on a fixing frame supporting the pressed article and capable of position adjustment in a direction of pressing of the press component against the pressed article; a fixing connection part, supporting the press component, mounted on the intermediate fixing member, and capable of position adjustment in the same direction as the direction of pressing; a setting part setting a distance of separation between the fixing connection part and the pressed article within a prescribed range; a first fixing mechanism fixing a position of the intermediate fixing member with respect to the fixing frame; and a second fixing mechanism fixing a position of the fixing connection part with respect to the intermediate fixing member.

Effect and Advantage

Using a component mounting structure of this configuration, the mounting position of the intermediate fixing member with respect to the fixing frame can be freely adjusted in the direction of pressing of the press component against the pressed article. Here, "the direction of pressing of the press component against the pressed article" is not limited to cases where pressing occurs perpendicular to the surface of the pressed article, but also includes pressing while maintaining a prescribed angle and pressing while changing the angle thereof (that is to say, while curving).

In addition, by adjusting the position of the fixing connection part supporting the press component, the mounting position of the press component with respect to the intermediate fixing member can also be freely adjusted in the above-described direction.

Furthermore, adjustment of the intermediate fixing member in the above-described direction to a suitable position with respect to the fixing frame makes reliable and accurate positioning possible using the first fixing mechanism, and in addition, adjustment of the fixing connection part in the above-described direction to a suitable position with respect to the intermediate fixing member makes reliable and accurate positioning possible using the second fixing mechanism.

It should be noted that this configuration comprises a setting section for setting the distance of separation between the fixing connection part supporting the press component and the pressed article to a prescribed range upon the above-described positioning. As a result of this, defects resulting from, for example, pressing of the press component against the pressed article with excessive or insufficient force are prevented. It should be noted that the condition of pressing of the press component against the pressed article (for example, the force applied by pressing or the degree of member shrinkage due to pressing) can be freely adjusted by changing the separation distance between the fixing connection part and the pressed article or by changing the setting of the setting section.

In this way, the component mounting structure of this configuration can be used to achieve accurate mounting while maintaining a condition of mutual pressing at a prescribed force between the pressed article and the press component, with no particular skill being required.

Second Characteristic Feature

The second characteristic feature of the present invention is that the press component is pressed against the pressed article along a direction of width, and the intermediate fixing member, the fixing connection part, the setting part, the first fixing mechanism, and the second fixing mechanism are each provided at each end of the press component in the pressing width direction.

Effect and Advantage

With a component mounting structure of this configuration, the force applied from both sides of the press component with respect to the pressed article is distributed in the direction of width, and a surface of the pressed article can be pressed uniformly.

Third Characteristic Feature

The third characteristic feature of the present invention is a that the setting part comprises a long hole provided in either one of the intermediate fixing member and the fixing connection part and an engaging hook provided on the other of the intermediate fixing member and the fixing connection part and capable of being engageably inserted into the long hole.

Effect and Advantage

With a component mounting structure of this configuration, the distance between the fixing connection part and the pressed article (that is, the distance between the press component and the pressed article) is set to a prescribed value as a result of the engaging hook provided on either the intermediate fixing member or the fixing connection part being engageably inserted into the long hole provided in the other of the intermediate fixing member and the fixing connection part. That is to say, as a result of an outer surface of the engaging hook coming into contact with an inner edge section of the long hole, the relative motion of the fixing connection part, supporting the press component, and the intermediate fixing member, secured to the fixing frame of the pressed article, is limited to within a fixed range. With a setting section configured in this way, a condition of elastic pressing with the press component pressing the pressed article with a suitable pressing force can be easily achieved.

It should be noted that, since the possible distance of separation between the fixing connection part and the pressed article is determined by the relationship between the diameter of the long hole and the width of the engaging hook, selection of suitable sizes of both will make it easier to set the desired separation distance.

Fourth Characteristic Feature

The fourth characteristic feature of the present invention is the provision of an impelling member pressing the press component against the pressed article.

Effect and Advantage

Through the action of the impelling member in a component mounting structure of this configuration, the press component can apply pressing force to the pressed article in a complete and reliable manner.

Furthermore, as relative motion of the fixing connection part supporting the press component and the intermediate fixing member is prevented by the impelling force of the impelling member, the process of position fixing using the second fixing mechanism becomes simpler and more precise.

Fifth Characteristic Feature

The fifth characteristic feature of the present invention is that either one of the pressed article and the press component is made of an elastic material, and the other of the pressed article and the press component is made of a hard material.

Effect and Advantage

With a component mounting structure of this configuration, with for example, the press component comprising an elastic member and the pressed article comprising a hard article, the press component can easily be pressed against the press article at a uniform force and in a reliable manner.

DESCRIPTION OF THE PREFERRED EMBODIMENTS

The following is a description of the embodiments of the present invention, with reference to the accompanying drawings.

Outline of a Configuration of an Image Forming Device

Figure 1:
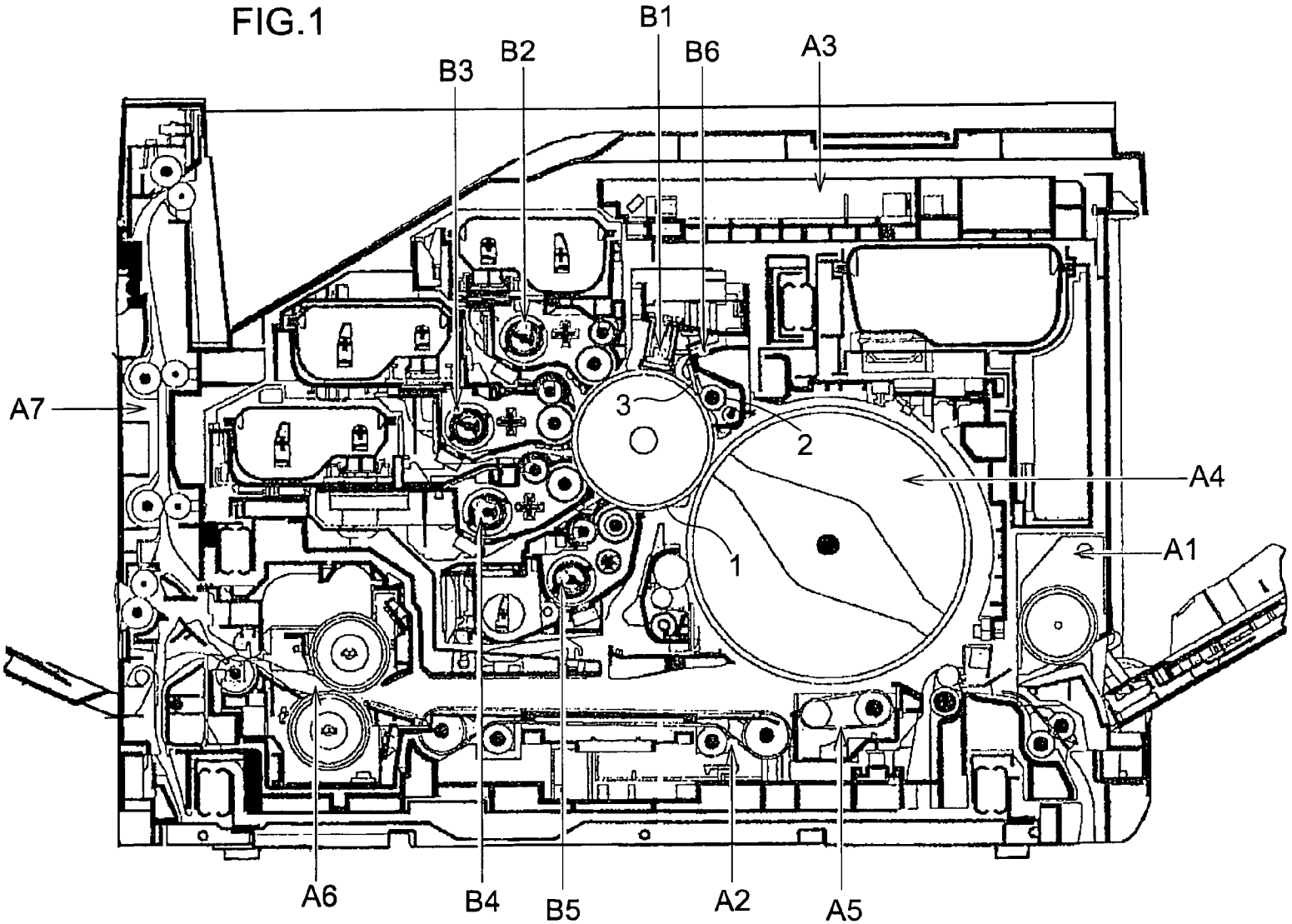
FIG. 1 is a side view illustrating the interior of an image forming device.

FIG. 1 shows a color printer as a typical example of an electrophotographic-type image forming device. The color printer comprises a multipurpose tray unit A1, a paper supply unit A2, a laser scanner unit A3, a primary transfer unit A4, a secondary transfer unit A5, a fixing unit A6, and a face-down tray unit A7.

Around a photoconductive drum 1, capable of being freely rotated, the primary transfer unit A4 has a rubbing roller 2 for polishing of an outer peripheral surface of the photoconductive drum 1, a cleaning blade 3 for cleaning of an outer peripheral surface of the photoconductive drum 1, a main charge unit B1, a yellow developing unit B2, a magenta developing unit B3, a cyan developing unit B4, a black developing unit B5, and other components, and the primary transfer unit A4 is configured so as to be capable of transferring a color toner image formed on the photoconductive drum 1 to printer paper.

Figure 2:
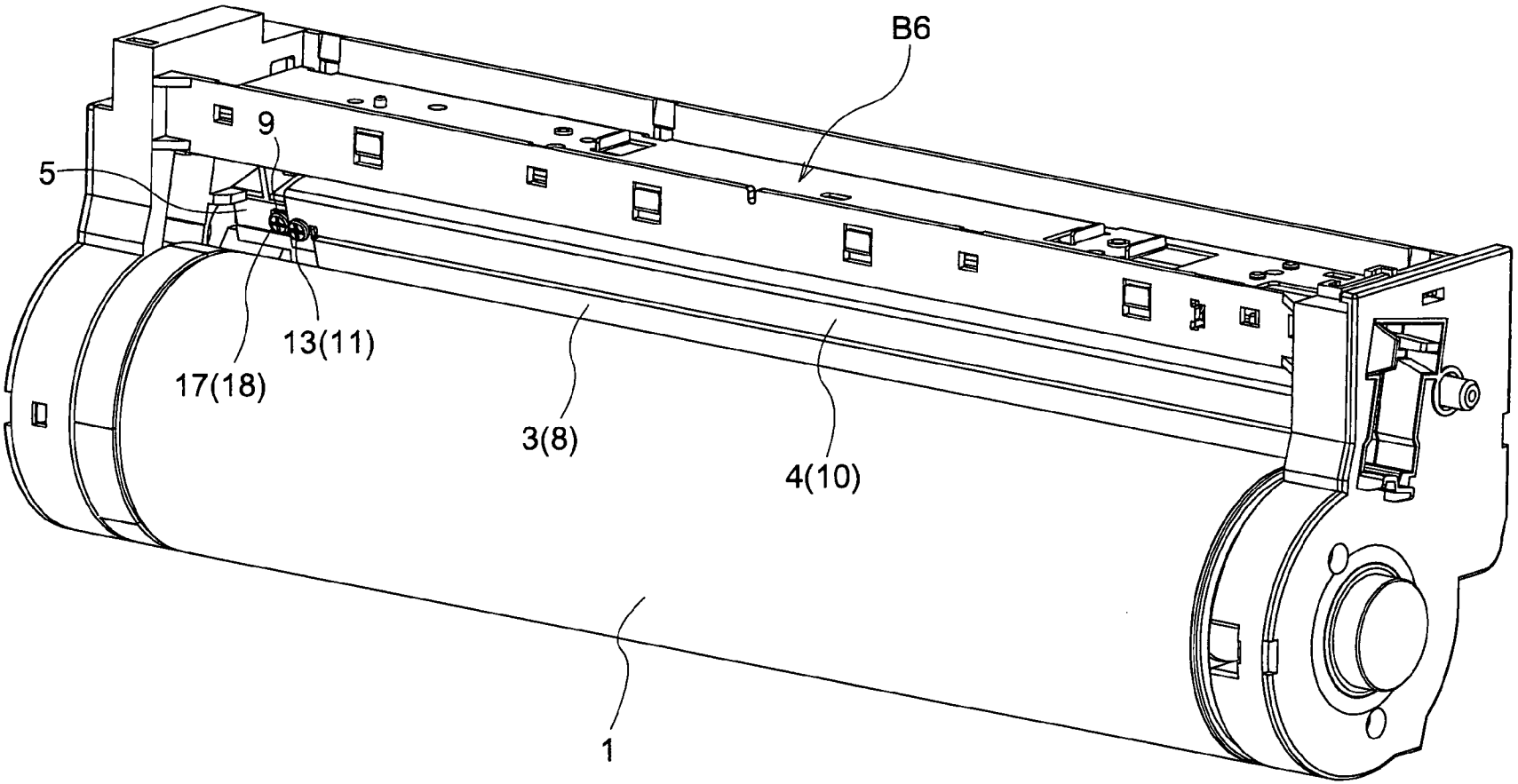
FIG. 2 is a perspective view of a drum unit.
Figure 3:
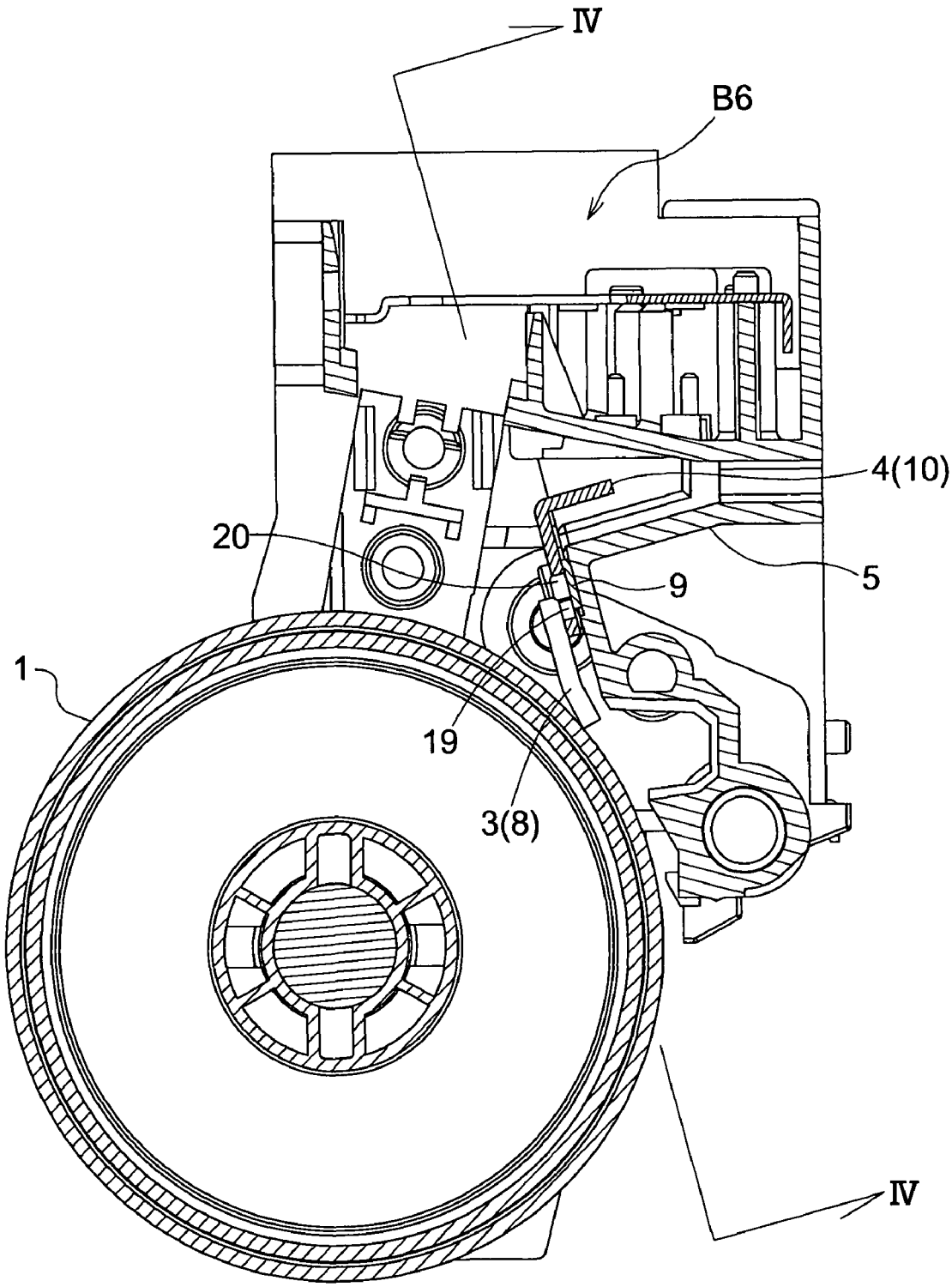
FIG. 3 is a longitudinal cross-section view of the main parts illustrating a component mounting structure.

The cleaning blade 3 is formed with a rectangular band shape using an elastic material such as rubber, and as shown in FIG. 2 and FIG. 3, is fixed to a base plate 4. The base plate 4 is mounted on a unit frame 5 of a drum unit B6, supporting the photoconductive drum 1 so as to be capable of rotating freely. The cleaning blade 3 fixed to the base plate 4 is disposed such that a longitudinal direction thereof is parallel to the drum axis and that a tip section thereof is pressed against a hard outer peripheral surface of the photoconductive drum 1 and elastically deformed with an approximately uniform width. When the photoconductive drum 1 rotates, residual toner remaining on the surface thereof is removed by the cleaning blade 3.

Figure 10:
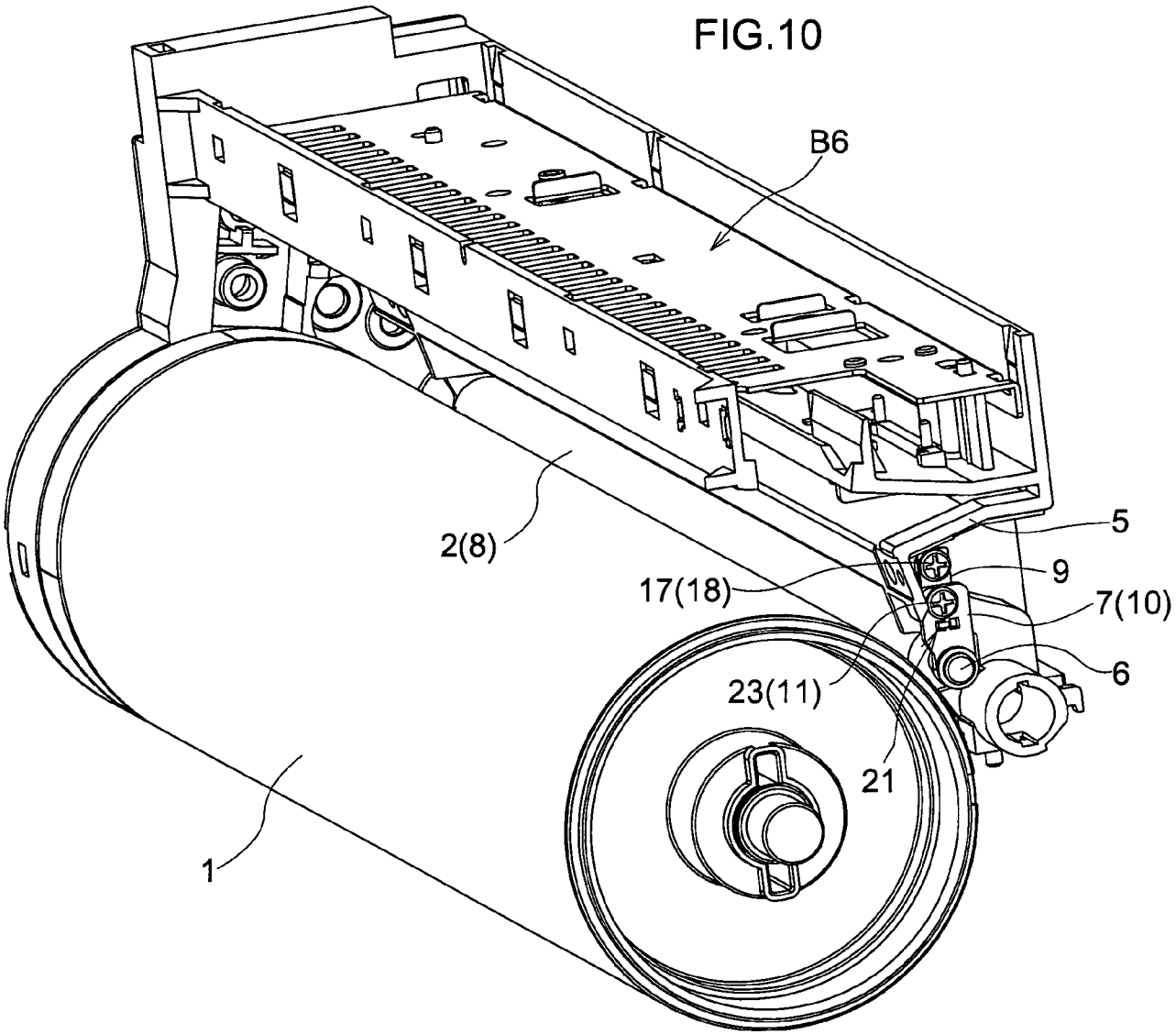
FIG. 10 is a perspective view of the drum unit illustrating a component mounting structure of Embodiment 2.
Figure 11:
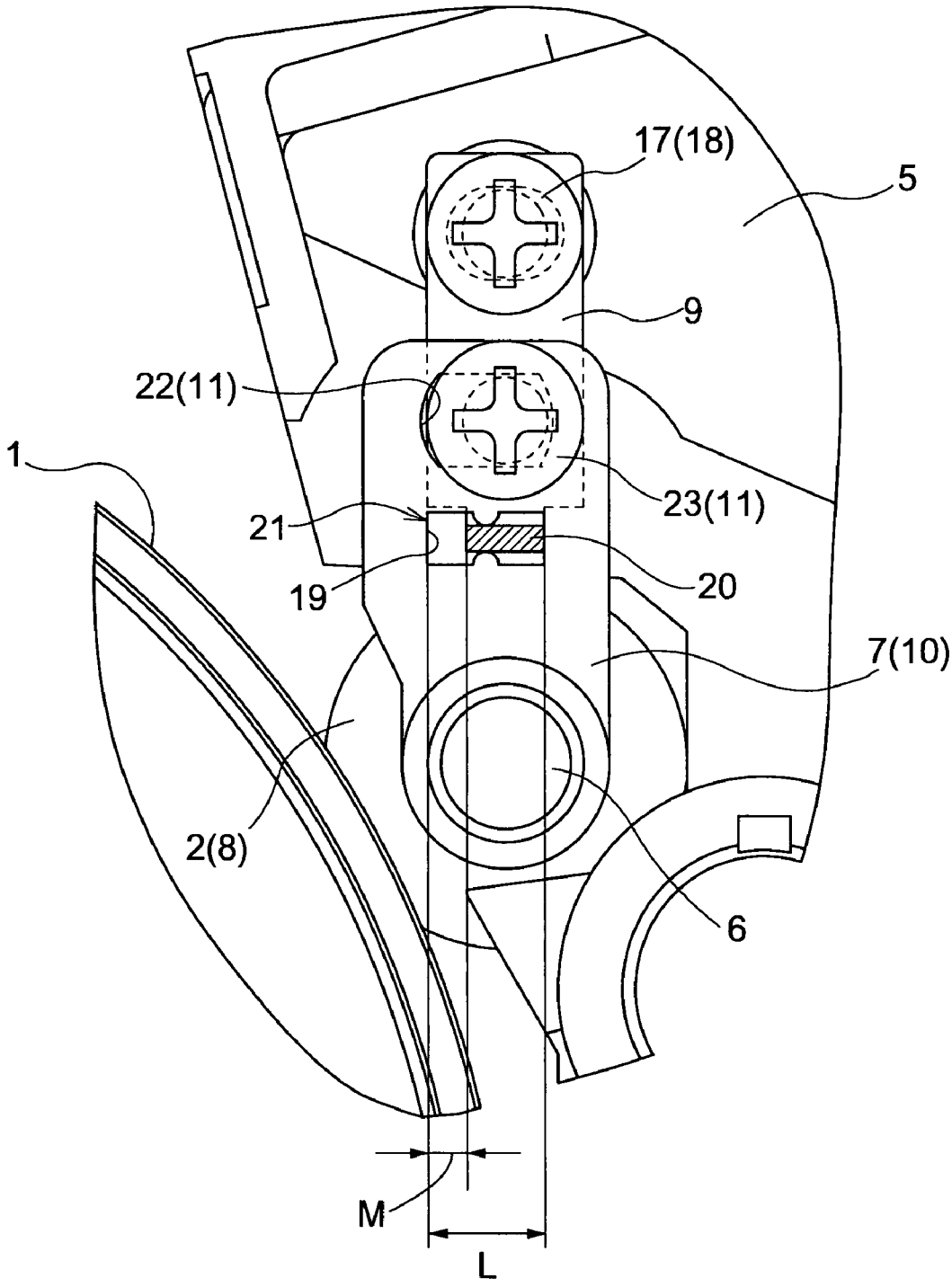
FIG. 11 is a side view of the main parts illustrating the component mounting structure of Embodiment 2.

The rubbing roller 2 is formed of an elastic material such as rubber, and as shown in FIG. 10 and FIG. 11, is concentrically fixed to a rotating shaft member 6. The rubbing roller 2 is disposed such that a longitudinal direction thereof is parallel to the drum axis and is pressed against an outer peripheral surface of the photoconductive drum 1 and elastically deformed with an approximately uniform width. Left and right brackets 7 supporting each of the ends of the rotating shaft member 6 so as to be capable of rotating freely are fixed to the unit frame 5, and in the above-described condition, the rubbing roller 2 is rotated at a different circumferential speed to the photoconductive drum 1. As a result of this, the outer peripheral surface of the photoconductive drum 1 is polished.

Embodiment 1

The following is a description of a component mounting structure according to a first embodiment of the present invention, with reference to accompanying drawings FIG. 2 to FIG. 9.

In the component mounting structure according to the first embodiment, the photoconductive drum 1 constitutes a pressed article and the cleaning blade 3 constitutes a press component 8 pressed against the pressed article 1, and with the pressed article 1 and the press component 8 (3) in a state of mutual elastic pressing, the press component 8 (3) is mounted on the unit frame 5 constituting a fixing frame of the pressed article 1.

As shown in FIG. 2 to FIG. 5, the base plate 4 securing the cleaning blade 3 is fixed to the unit frame 5 through an action of left and right adjusting plates 9 constituting intermediate fixing members. The base plate 4 constitutes a fixing connection part 10 upon the mounting of the cleaning blade 3 on the adjusting plates 9. Furthermore, first fixing mechanisms 18, positioning the left and right adjusting plates 9 with respect to the unit frame 5, and second fixing mechanisms 11, positioning the base plate 4 with respect to left and right adjusting plates 9, are each provided on the left and right sides.

Figure 5:
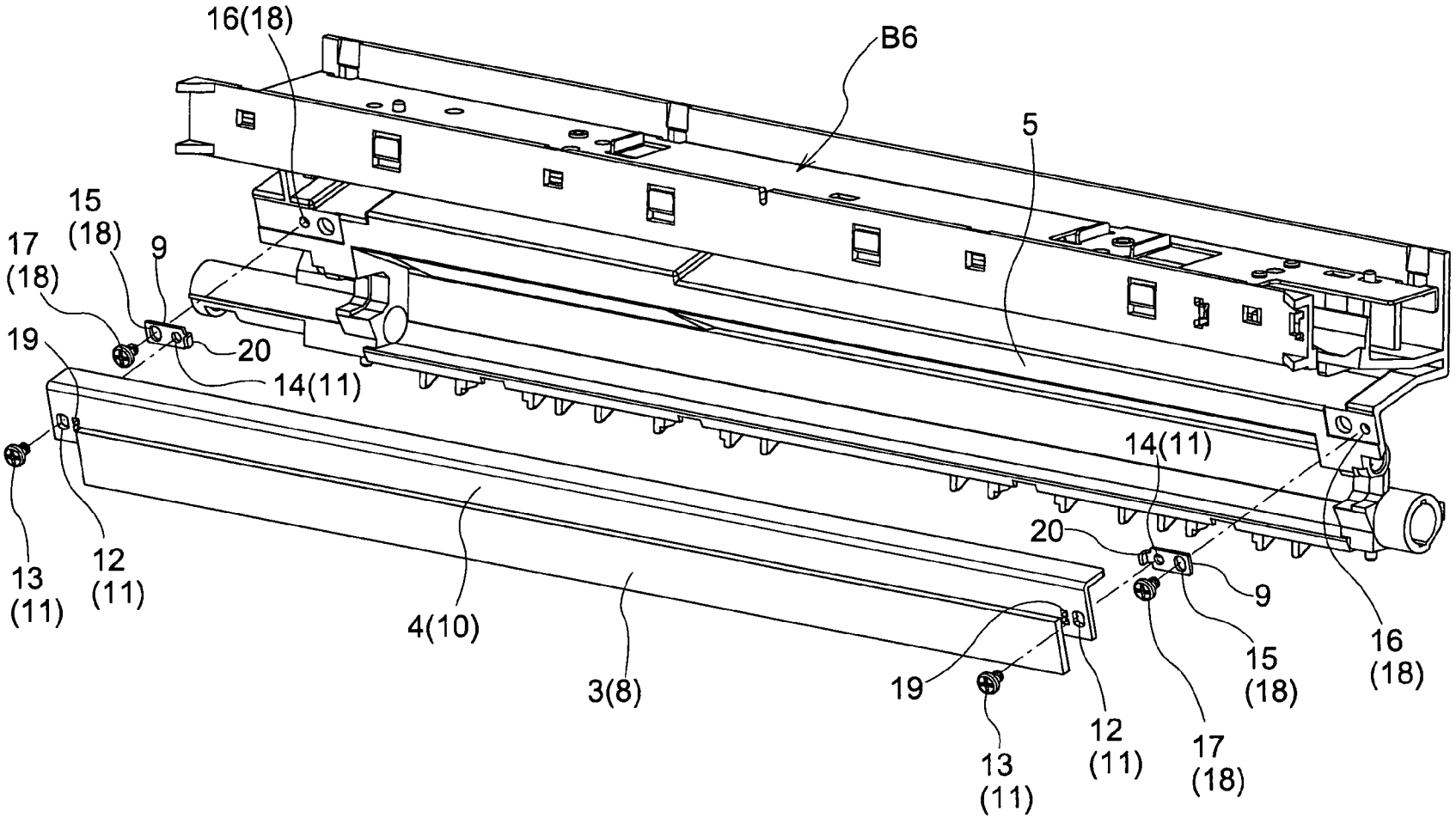
FIG. 5 is an exploded perspective view illustrating a component mounting structure.

As shown in FIG. 5, each of the first fixing mechanisms 18 is configured by forming an adjusting-plate hole 15 in each of the left and right adjusting plates 9, forming a female screw hole 16 in each of the left and right sides of the unit frame 5, and screwing an adjusting-plate fixing screw 17 passed through the adjusting-plate hole 15 into the female screw hole 16. In this way, the positions of the left and right adjusting plates 9 are fixed with respect to the unit frame 5.

Meanwhile, each of the second fixing mechanisms 11 is configured by forming a base-plate hole 12 in each of the left and right sides of the base plate 4, and screwing a base-plate fixing screw 13 passed through the base-plate hole 12 into a female screw hole 14 formed in each of the left and right adjusting plates 9. In this way, the positions of the left and right sides of the base plate 4 are fixed with respect to the left and right adjusting plates 9.

The adjusting-plate holes 15 are formed as long holes aligned with the direction of pressing of the cleaning blade 3 against the photoconductive drum 1. When the base plate 4 is mounted on the left and right adjusting plates 9, therefore, this sets a range of motion of the left and right adjusting plates 9 with respect to the unit frame (a fixing frame) 5 such that the cleaning blade 3 can be brought into contact with an outer peripheral surface of the photoconductive drum 1.

Furthermore, the base-plate holes 12 are also formed as long holes aligned with the direction of pressing of the cleaning blade 3 against the photoconductive drum 1. In this way, the base plate 4 can be mounted such that the position thereof with respect to the left and right adjusting plates 9 is adjustable in the same direction as the direction of pressing.

In addition, approximately rectangular long holes 19 for engagement are formed so as to pass through each of the two ends of the base plate 4 with a longitudinal direction thereof parallel to the direction of pressing of the cleaning blade 3. Engaging hooks 20, formed on the left and right adjusting plates 9 by cutting and raising, are engageably inserted into these long holes 19. The length of the engaging hooks 20 in the direction of pressing of the cleaning blade 3 is shorter than the length L of the long holes 19 by a prescribed amount (a prescribed distance) M. When the engaging hook 20 is engageably inserted into the long hole 19, an outer surface of the engaging hook 20 makes contact with an inner edge section of the long hole 19. As a result, the relative motion of the base plate 4, supporting the cleaning blade 3, and the adjusting plates 9, secured to the unit frame 5 of the photoconductive drum 1, is limited to within a fixed range. A setting section 21 setting a distance of separation between the base plate 4, supporting the cleaning blade 3 brought into contact with an outer peripheral surface of the photoconductive drum 1, and the photoconductive drum 1 (or in other words, a distance through which the cleaning blade 3 can move so as to approach the photoconductive drum 1) to the range of the prescribed distance M is thus configured.

It should be noted that the engaging hooks 20 can be formed on the base plate 4 and the long holes 19 can be formed in the adjusting plates 9 so as to configure the setting section 21.

As described above, the adjusting plate 9, the base plate 4, the setting section 21, the first fixing mechanism 18, and the second fixing mechanism 11 are configured and provided at each end in a width direction of the cleaning blade 3 pressed against the photoconductive drum 1. In this way, the force applied from both sides of the cleaning blade 3 with respect to the photoconductive drum 1 is distributed in the direction of width. Consequently, a surface of the photoconductive drum 1 can be pressed uniformly by the cleaning blade 3.

However, in the case of special requirements such as a need to concentrate cleaning in the vicinity of the central section of the photoconductive drum 1, the force of pressing against the photoconductive drum 1 can be distributed as required by, for example, slightly curving the cleaning blade 3 so as to protrude at the central section thereof.

The following is a description of a procedure for mounting the cleaning blade 3, secured to the base plate 4, on the unit frame 5.

Figure 6:
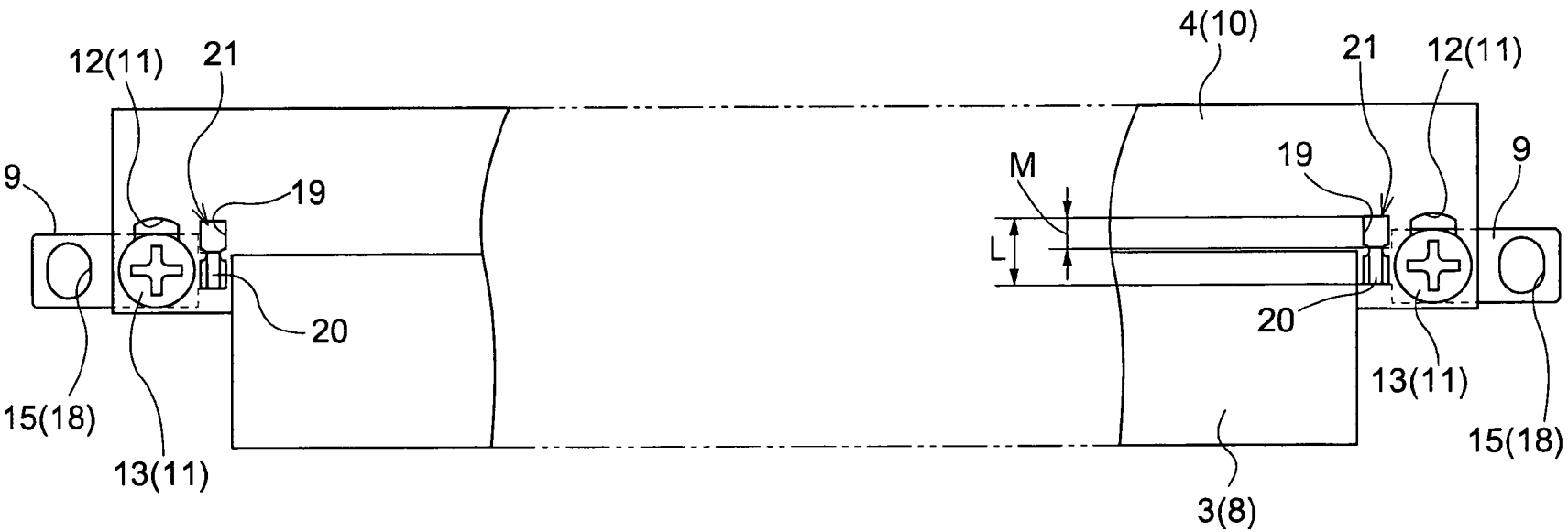
FIG. 6 is a plan view of the main parts illustrating the mounting method of the component mounting structure.
Figure 7:
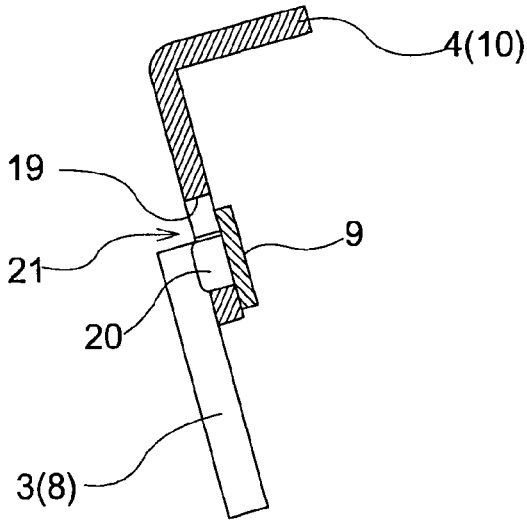
FIG. 7 is a longitudinal cross-section view of the main parts illustrating the mounting method of the component mounting structure.

As shown in FIG. 6 and FIG. 7, the engaging hooks 20 of the left and right adjusting plates 9 are inserted into the left and right long holes 19 in the base plate 4, and outer surfaces of the engaging hooks 20 are brought into contact with inner edge sections of the long holes 19 at the bottom thereof in the direction of pressing. In this condition, the base-plate fixing screws 13 passed through the base-plate holes 12 are screwed into the female screw holes 14 in the left and right adjusting plates 9. In this way, the base plate 4 is temporarily (or loosely) secured to the adjusting plates 9.

Figure 8:
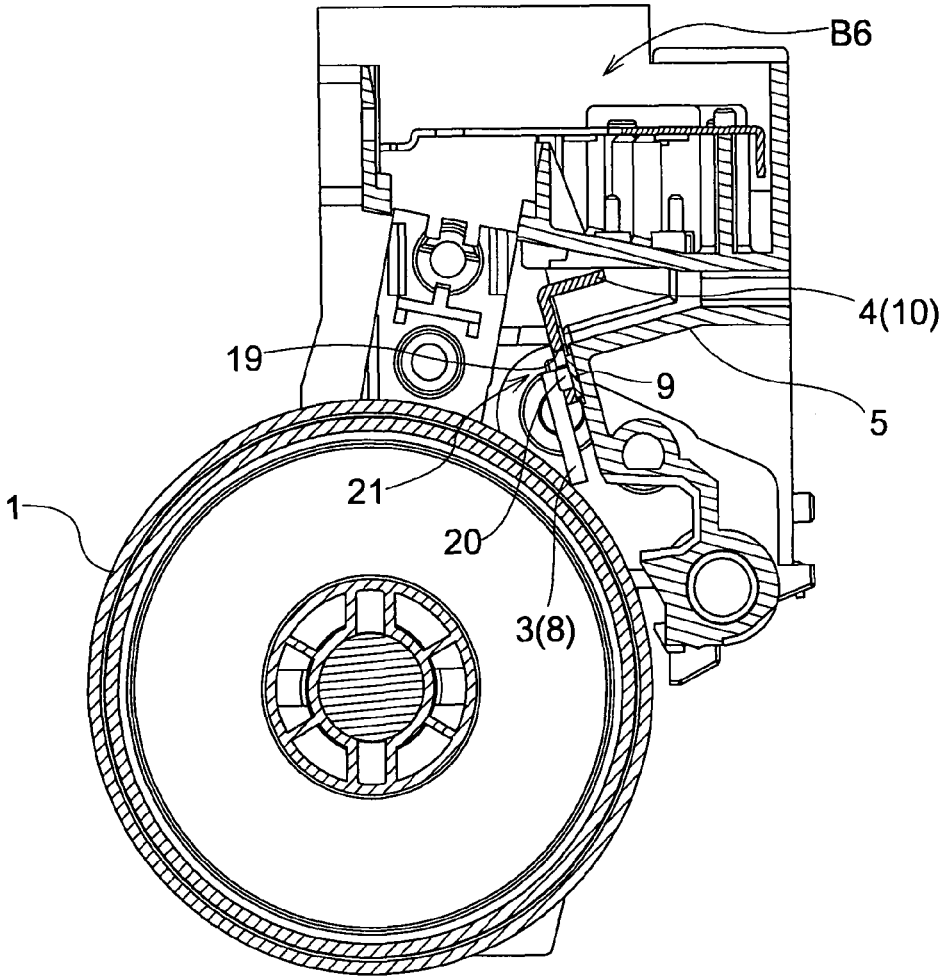
FIG. 8 is a longitudinal cross-section view of the main parts illustrating the mounting method of the component mounting structure.
Figure 9:
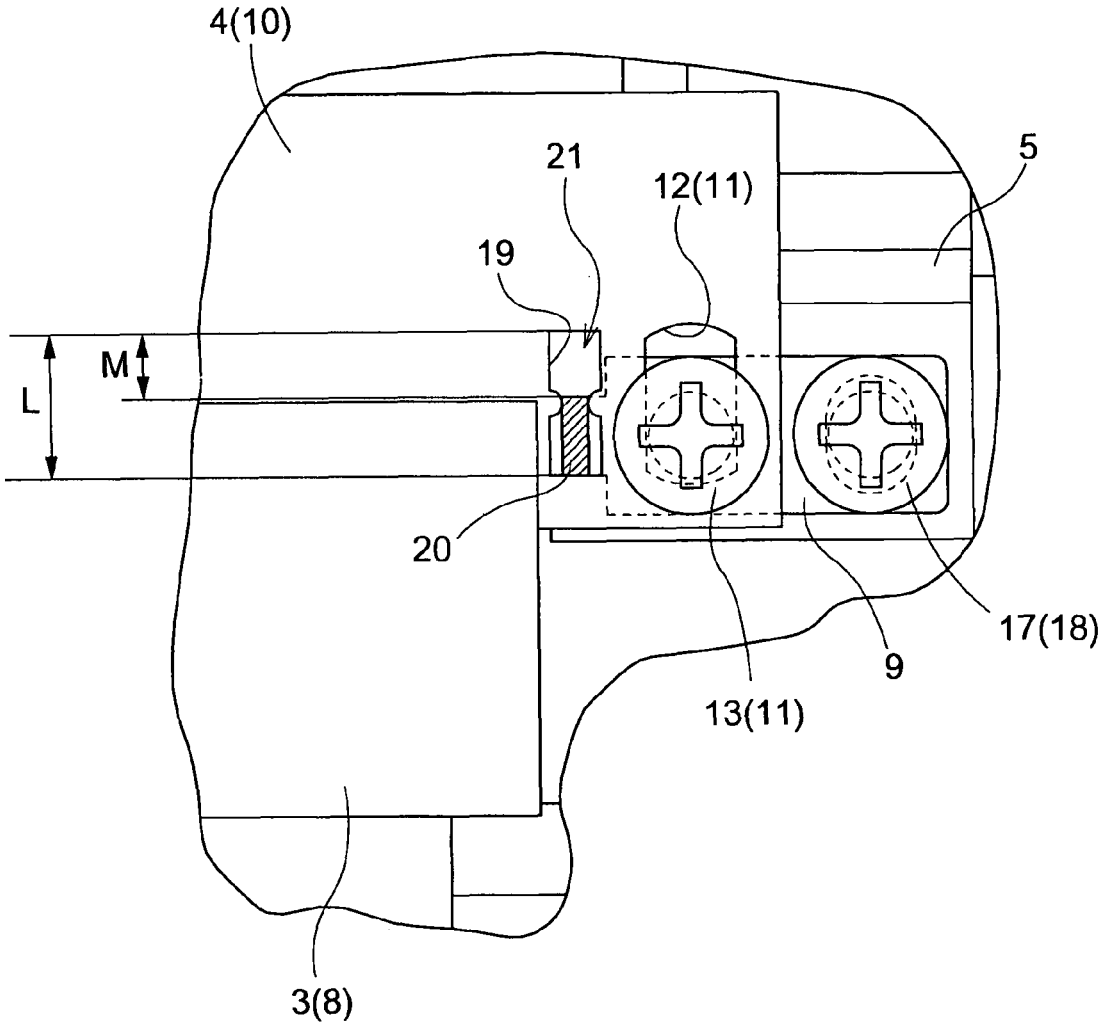
FIG. 9 is a side view of the main parts illustrating the mounting method of the component mounting structure.

Next, as shown in FIG. 8 and FIG. 9, with the tip section of the cleaning blade 3 in contact with an outer peripheral surface of the photoconductive drum 1, the adjusting-plate fixing screws 17 passed through the adjusting-plate holes 15 are screwed into the female screw holes 16 in the unit frame 5. In this way, the adjusting plates 9 are permanently (or fully) secured to the unit frame 5.

Figure 4:
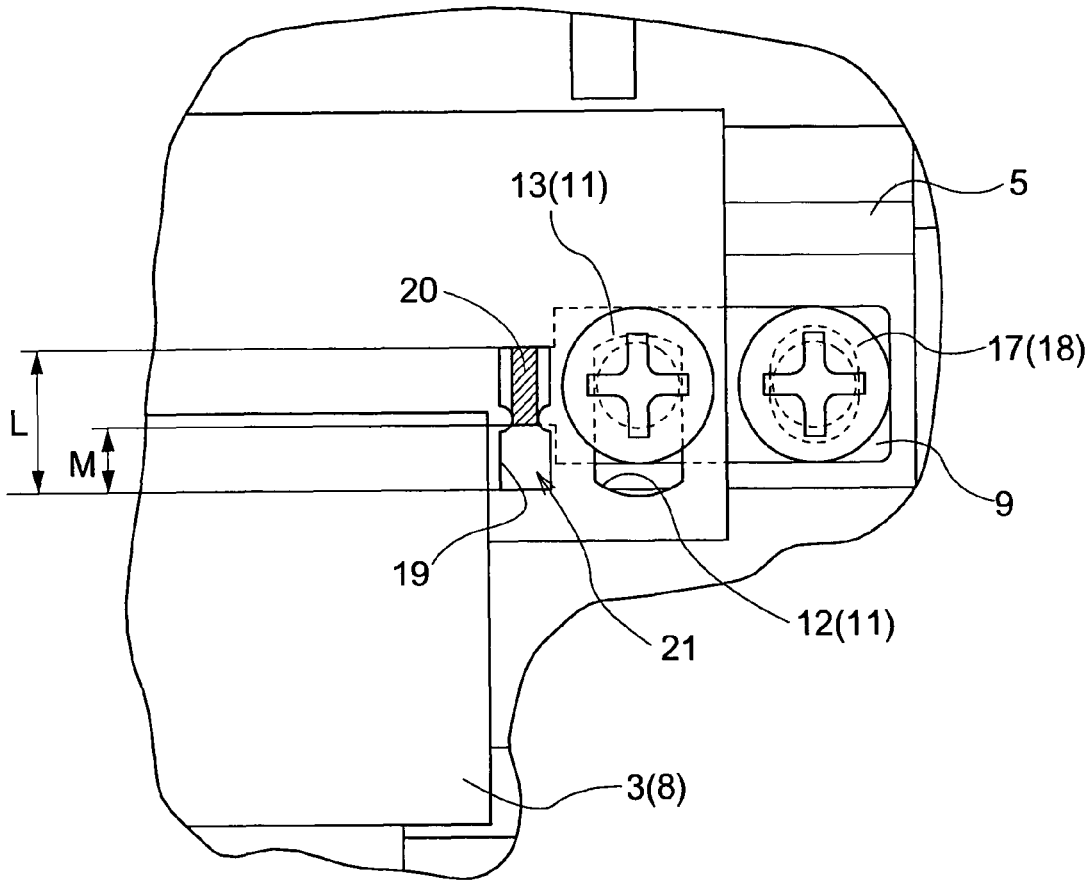
FIG. 4 is a side view (as viewed in the direction of Arrow IV of FIG. 3) of the main parts illustrating a component mounting structure.

Next, the base-plate fixing screws 13 are loosened, and the base plate 4 is moved such that outer peripheral surfaces of the engaging hooks 20 of the left and right adjusting plates 9 are brought into contact with inner edge sections of the engaging long holes 19 at the top thereof in the direction of pressing. In this way, the base plate 4 moves through the prescribed distance M towards the photoconductive drum 1. The base-plate fixing screws 13 are tightened in this condition, permanently (or fully) securing the base plate 4 through an action of the left and right adjusting plates 9 so as to be incapable of motion with respect to the unit frame 5. Consequently, as shown in FIG. 3 and FIG. 4, the cleaning blade 3 is mounted such that a tip section thereof presses against an outer peripheral surface of the photoconductive drum 1 with a prescribed force of elastic pressing.

Embodiment 2

The following is a description of a component mounting structure according to a second embodiment of the present invention, with reference to accompanying drawings FIG. 10 to FIG. 15.

In the component mounting structure according to the second embodiment, the photoconductive drum 1 constitutes a pressed article and a rubbing roller 2 constitutes a press component 8 pressed against the pressed article 1, and with the pressed article 1 and the press component 8 (2) in a state of mutual elastic pressing, the press component 8 (2) is mounted on the unit frame 5 constituting a fixing frame of the pressed article 1.

Figure 12:
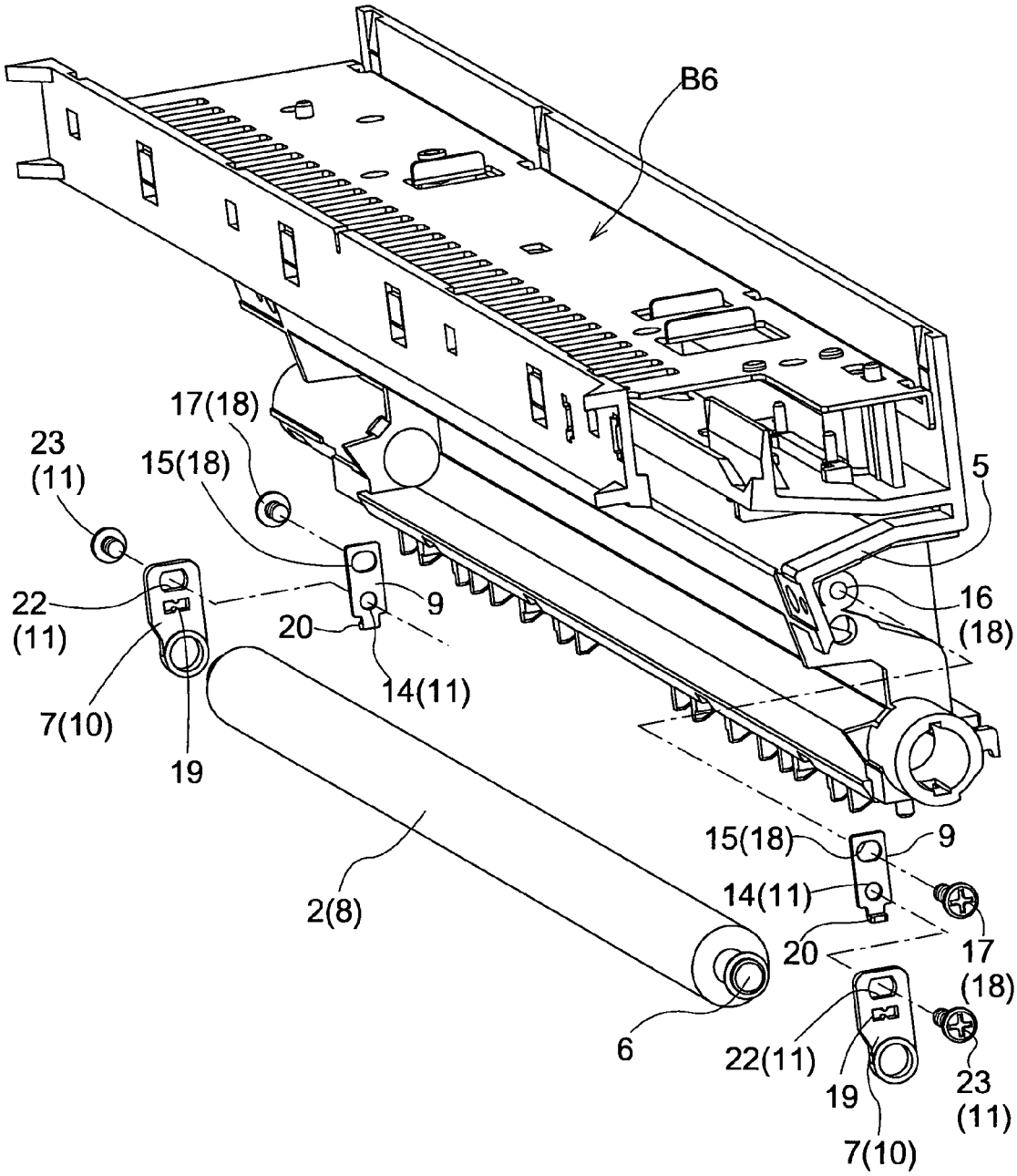
FIG. 12 is an exploded perspective view illustrating the component mounting structure of Embodiment 2.

As shown in FIG. 10 to FIG. 12, the brackets 7 securing the rubbing roller 2 are fixed to the unit frame 5 through an action of left and right adjusting plates 9 constituting intermediate fixing members. The bracket 7 constitutes a fixing connection part 10 upon the mounting of the rubbing roller 2 on the adjusting plates 9. Furthermore, first fixing mechanisms 18, positioning the left and right adjusting plates 9 with respect to the unit frame 5, and second fixing mechanisms 11, positioning the brackets 7 with respect to left and right adjusting plates 9, are each provided on of the left and right sides.

As shown in FIG. 12, each of the first fixing mechanisms 18 is configured by forming an adjusting-plate hole 15 in each of the left and right adjusting plates 9, forming a female screw hole 16 in each of the left and right sides of the unit frame 5, and screwing an adjusting-plate fixing screw 17 passed through the adjusting-plate hole 15 into the female screw hole 16. In this way, the positions of the left and right adjusting plates 9 are fixed with respect to the unit frame 5.

Meanwhile, each of the second fixing mechanisms 11 is configured by forming a bracket hole 22 formed in each of the left and right brackets 7, and screwing a bracket fixing screw 23 passed through the bracket hole 22 into a female screw hole 14 formed in each of the left and right adjusting plates 9. In this way, the positions of the brackets 7 are fixed with respect to the left and right adjusting plates 9.

The adjusting-plate holes 15 are formed as long holes aligned with the direction of pressing of the rubbing roller 2 against the photoconductive drum 1. When the brackets 7 are mounted on the left and right adjusting plates 9, therefore, this sets a range of motion of the left and right adjusting plates 9 with respect to the unit frame (a fixing frame) 5 such that the rubbing roller 2 can be brought into contact with an outer peripheral surface of the photoconductive drum 1.

Furthermore, the bracket holes 22 are also formed as long holes aligned with the direction of pressing of the rubbing roller 2 against the photoconductive drum 1. In this way, the brackets 7 can be mounted such that the positions thereof with respect to the left and right adjusting plates 9 are adjustable in the same direction as the direction of pressing.

In addition, approximately rectangular long holes 19 for engagement are formed so as to pass through each of the brackets 7 with a longitudinal direction thereof parallel to the direction of pressing of the rubbing roller 2. Engaging hooks 20, formed on the left and right adjusting plates 9 by cutting and raising, are engageably inserted into these long holes 19. The length of the engaging hooks 20 in the direction of pressing of the rubbing roller 2 is shorter than the length L of the long holes 19 by a prescribed amount (a prescribed distance) M. When the engaging hook 20 is engageably inserted into the long hole 19, an outer surface of the engaging hook 20 makes contact with an inner edge section of the long hole 19. As a result, the relative motion of the brackets 7, supporting the rubbing roller 2, and the adjusting plates 9, secured to the unit frame 5 of the photoconductive drum 1, is limited to within a fixed range. A setting section 21 setting a distance of separation between the brackets 7, supporting the rubbing roller 2 brought into contact with an outer peripheral surface of the photoconductive drum 1, and the photoconductive drum 1 (or in other words, a distance through which the rubbing roller 2 can move so as to approach the photoconductive drum 1) to the range of the prescribed distance M is thus configured.

It should be noted that the engaging hooks 20 can be formed on the brackets 7 and the long holes 19 can be formed on the adjusting plates 9 so as to configure the setting section 21.

As described above, the adjusting plate 9, the bracket 7, the setting section 21, the first fixing mechanism 18, and the second fixing mechanism 11 are configured and provided at each end in a width direction of the rubbing roller 2 pressed against the photoconductive drum 1. In this way, the force applied from both sides of the rubbing roller 2 with respect to the photoconductive drum 1 is distributed in the direction of width. Consequently, a surface of the photoconductive drum 1 can be pressed uniformly by the rubbing roller 2.

However, in the case of special requirements such as a need to concentrate rubbing in the vicinity of the central section of the photoconductive drum 1, the force of pressing against the photoconductive drum 1 can be distributed as required by, for example, varying the diameter of the rubbing roller 2 slightly in the direction of width so as to protrude at the central section thereof.

The following is a description of a procedure for mounting the rubbing roller 2, supported by the brackets 7 so as to be capable of rotating freely, on the unit frame 5.

Figure 13:
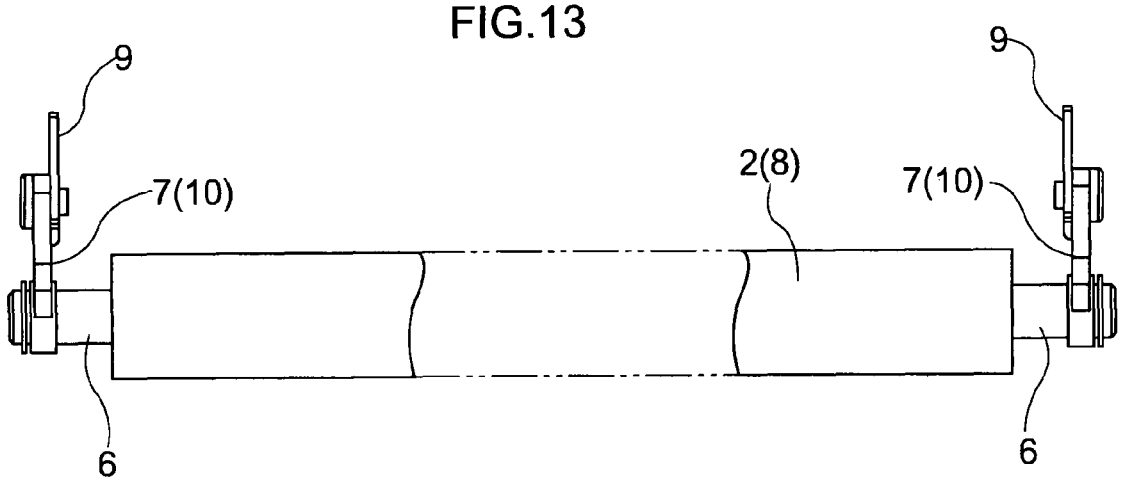
FIG. 13 is a plan view of the main parts illustrating the mounting method of the component mounting structure of Embodiment 2.
Figure 14:
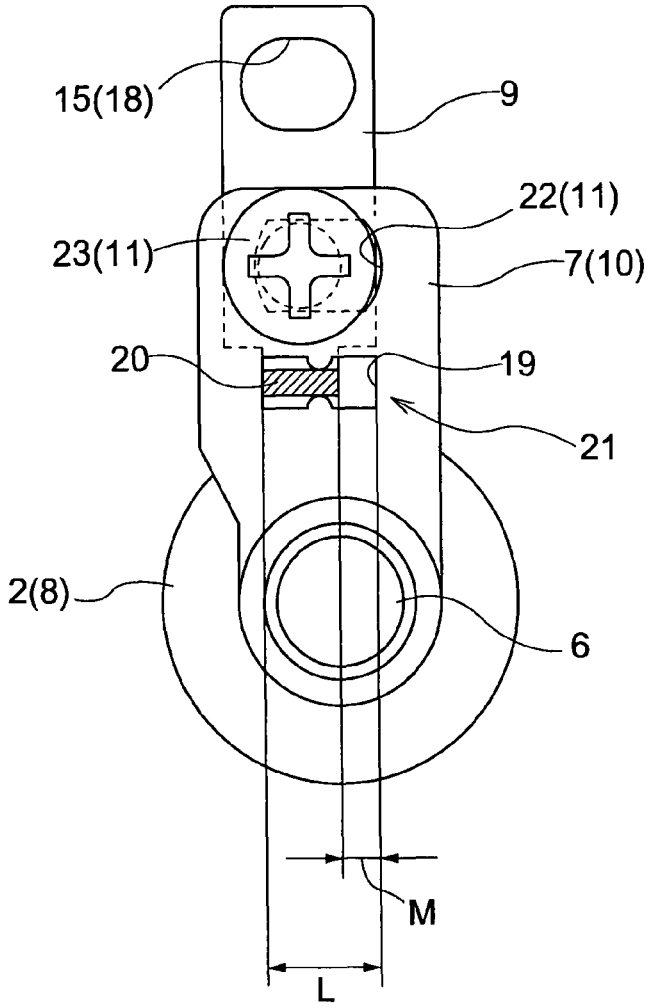
FIG. 14 is a side view of the main parts illustrating the mounting method of the component mounting structure of Embodiment 2.

As shown in FIG. 13 and FIG. 14, the engaging hooks 20 of the left and right adjusting plates 9 are inserted into the left and right long holes 19 in the brackets 7, and outer surfaces of the engaging hooks 20 are brought into contact with inner edge sections of the long holes 19 at the bottom thereof in the direction of pressing. In this condition, the bracket fixing screws 23 passed through the bracket holes 22 are screwed into the female screw holes 14 in the left and right adjusting plates 9. In this way, the brackets 7 are temporarily (or loosely) secured to the adjusting plates 9.

Figure 15:
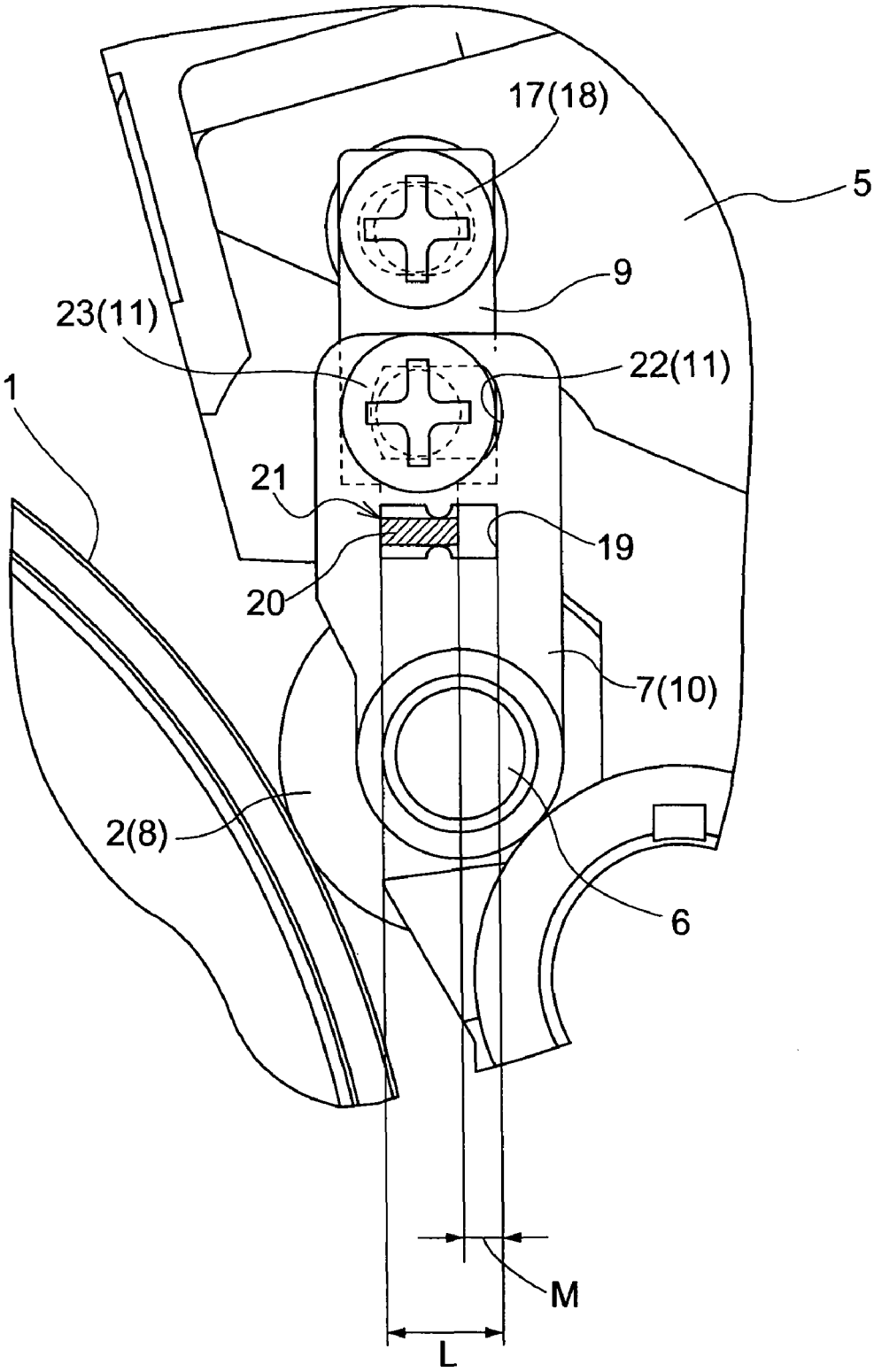
FIG. 15 is a side view of the main parts illustrating the mounting method of the component mounting structure of Embodiment 2.

Next, as shown in FIG. 15, with a peripheral surface of the rubbing roller 2 in a state of approximately linear contact with an outer peripheral surface of the photoconductive drum 1 as a result of, for example, the dead weight of the rubbing roller 2, the adjusting-plate fixing screws 17 passed through the adjusting-plate holes 15 are screwed into the female screw holes 16 in the unit frame 5. In this way, the adjusting plates 9 are permanently (or fully) secured to the unit frame 5.

Next, the bracket fixing screws 23 are loosened, and the brackets 7 are moved such that outer peripheral surfaces of the engaging hooks 20 of the left and right adjusting plates 9 are brought into contact with inner edge sections of the engaging long holes 19 at the top thereof in the direction of pressing. In this way, the brackets 7 move through the prescribed distance M towards the photoconductive drum 1. The bracket fixing screws 23 are tightened in this condition, permanently (or fully) securing the brackets 7 through an action of the left and right adjusting plates 9 so as to be incapable of motion with respect to the unit frame 5. Consequently, as shown in FIG. 10 and FIG. 11, the rubbing roller 2 is mounted such that a peripheral surface thereof presses against an outer peripheral surface of the photoconductive drum 1 with a prescribed force of elastic pressing.

Other Embodiments

Figure 16:
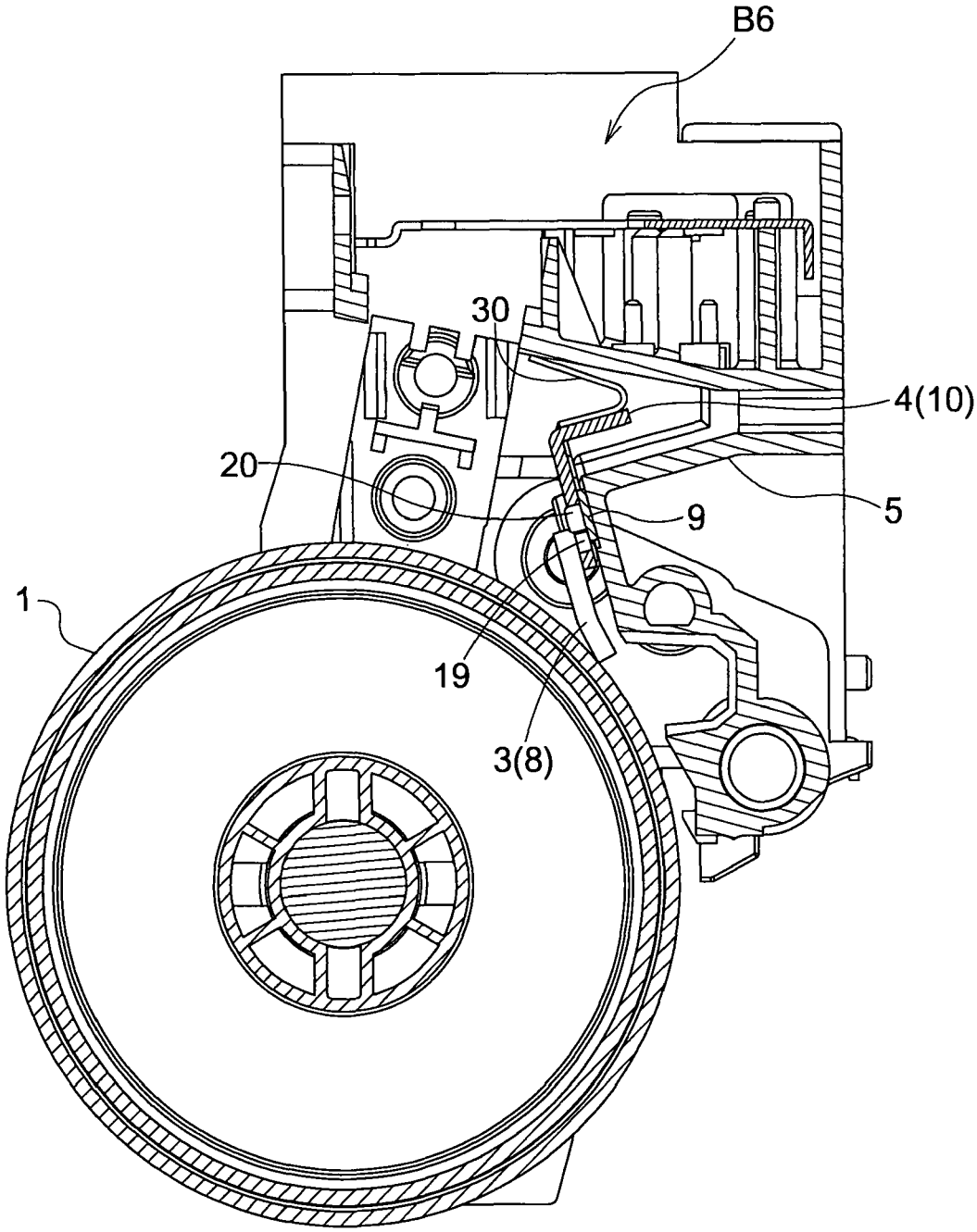
FIG. 16 is a longitudinal cross-section view of the main parts illustrating a component mounting structure containing an impelling material.

1. The component mounting structure according to the present invention can be provided with an impelling material upon pressing of the press component against the pressed article. In terms of the component mounting structure according to Embodiment 1, for example, FIG. 16 shows a configuration with a leaf spring 30 disposed between the base plate 4, supporting the cleaning blade 3, and the unit frame 5. When set in position, the cleaning blade 3 is acted upon by an impelling force from the leaf spring 30 through an action of the base plate 4. As a result, the photoconductive drum 1 and the cleaning blade 3 are held in a state of mutual elastic pressing by the impelling force of the leaf spring 30. Consequently, the cleaning blade 3 can apply pressing force to the photoconductive drum 1 in a complete and reliable manner.

Furthermore, as relative motion between the base plate 4, supporting the cleaning blade 3, and the adjusting plates 9 is prevented by the impelling force of the leaf spring 30, the process of positioning using the second fixing mechanism 11 becomes simpler and more precise. It should be noted that, although the leaf spring 30 is mounted on the base plate 4 for the purpose of this example, the leaf spring 30 can also be mounted on the unit frame 5.

2. In the component mounting structure according to the present invention, either the pressed article and the press component can comprise an elastic material, with the other comprising a hard material. In terms of the component mounting structure according to Embodiment 2, for example, a surface of the rubbing roller 2 shown in FIG. 10 comprises the elastic material silicone rubber, and a surface of the photoconductive drum 1 comprises the hard material amorphous silicon. As a result of this, pressing of the rubbing roller 2 against the photoconductive drum 1 in a reliable manner and with a uniform pressing force becomes easier to achieve.

3. The component mounting structure according to the present invention is not limited with respect to the number or type of press components elastically pressed against the pressed article, and a plurality of press components or types thereof can be press assembled. For example, two rows of cleaning blades 3 can be disposed in parallel with the direction of width of the photoconductive drum 1, and the cleaning blade 3 and the rubbing roller 2 can be simultaneously placed against the photoconductive drum 1.

4. The component mounting structure according to the present invention may have, for example, a fixing roller of the fixing section of an electrophotographic-type image forming device as the pressed article and a pressure roller as the press component, in which with the pressed article and the press component in a condition of mutual elastic pressing with a prescribed nip width, the press component can be mounted on the component mounting structure, and there is no limitation to combined articles as the pressed article and the press component and the purpose of use thereof.

Furthermore, if the mode of use of the component mounting structure according to the present invention is such that the press component is elastically pressed against the pressed article, application thereof is not limited to image forming devices as explained in the above embodiments and can include other types of device.

What is claimed is:

1. A component mounting structure mounting a press component with the press component in a condition of elastic pressing against a pressed article, comprising:

an intermediate fixing member mounted on a fixing frame supporting the pressed article and capable of position adjustment in a direction of pressing of the press component against the pressed article;

a fixing connection part, supporting the press component, mounted on the intermediate fixing member, and capable of position adjustment in the same direction as the direction of pressing;

a setting part setting a distance of separation between the fixing connection part and the pressed article within a prescribed range;

a first fixing mechanism fixing a position of the intermediate fixing member with respect to the fixing frame; and a second fixing mechanism fixing a position of the fixing connection part with respect to the intermediate fixing member, wherein the setting part comprises a long hole provided in either one of the intermediate fixing member and the fixing connection part and an engaging hook provided on the other of the intermediate fixing member and the fixing connection part and capable of being engageably inserted into the long hole.

2. A component mounting structure mounting a press component with the press component in a condition of elastic pressing against a pressed article, comprising:

an intermediate fixing member mounted on a fixing frame supporting the pressed article and capable of position adjustment in a direction of pressing of the press component against the pressed article;

a fixing connection part, supporting the press component, mounted on the intermediate fixing member, and capable of position adjustment in the same direction as the direction of pressing;

a setting part setting a distance of separation between the fixing connection part and the pressed article within a prescribed range;

a first fixing mechanism fixing a position of the intermediate fixing member with respect to the fixing frame; and a second fixing mechanism fixing a position of the fixing connection part with respect to the intermediate fixing member; and an impelling member pressing the press component against the pressed article.

* * * * *